United States Patent [19]

Lawson

[11] 4,240,737

[45] Dec. 23, 1980

[54] PROCESSING OF RADIATION SENSITIVE DEVICES

[75] Inventor: Leslie E. Lawson, Orpington, England

[73] Assignee: Vickers Limited, London, England

[21] Appl. No.: 45,590

[22] Filed: Jun. 4, 1979

Related U.S. Application Data

[63] Continuation of Ser. No. 934,029, Aug. 16, 1978, abandoned.

[51] Int. Cl.[3] ..... G03D 13/00

[52] U.S. Cl. ..... 354/299; 354/306; 354/321; 354/328; 134/57 R; 134/122 P; 118/666; 430/309; 430/325; 430/434

[58] Field of Search ..... 354/299, 306, 317, 318, 354/319, 320, 321, 322, 323, 324, 325, 326, 328, 297; 134/57 R, 113, 64 P, 122 P; 118/6, 5; 366/144

[56] References Cited

U.S. PATENT DOCUMENTS

| | | | |
|---|---|---|---|
| 2,794,377 | 6/1957 | Fairbank | 354/299 |
| 3,133,490 | 5/1964 | Buck | 354/299 |
| 3,511,160 | 5/1970 | Reusel | 354/298 |
| 3,623,416 | 6/1968 | Anderberg | 354/306 |
| 3,625,131 | 12/1971 | Puls | 354/318 |
| 3,999,511 | 12/1976 | Schwandt | 354/318 |
| 4,081,211 | 3/1978 | Shigeta et al. | 354/299 |
| 4,104,668 | 8/1978 | Laar | 354/299 |
| 4,128,326 | 12/1978 | Selak | 354/317 |
| 4,130,825 | 12/1978 | Fassano | 354/328 |
| 4,153,363 | 5/1979 | Albano | 354/299 |

FOREIGN PATENT DOCUMENTS

| | | | |
|---|---|---|---|
| 2438179 | 2/1976 | Fed. Rep. of Germany | 354/299 |

*Primary Examiner*—Richard A. Wintercorn
*Assistant Examiner*—Alan Mathews
*Attorney, Agent, or Firm*—Reed, Smith, Shaw & McClay

[57] ABSTRACT

During the processing of an image-wise exposed radiation sensitive device, such as a radiation sensitive plate for lithographic printing plate production, by contacting the device with developer liquid, a temperature sensitive member is immersed in the developer liquid. The member produces an output signal in dependence on the temperature of the developer liquid. This signal is used to control the degree to which the device is processed in a manner dependent on the temperature of the developer liquid for example by controlling the residence time of the device in the developer liquid, by controlling the degree to which the developer liquid is agitated in contact with the device, or by controlling the degree to which the device is subjected to an overall exposure to radiation prior to or during contact with the developer liquid.

9 Claims, 9 Drawing Figures

PROCESSING OF RADIATION SENSITIVE DEVICES

This is a continuation of application Ser. No. 934,029 filed Aug. 16, 1978.

This invention relates to the processing of radiation sensitive devices comprising a radiation-sensitive coating on a substrate.

Such radiation sensitive devices are used in the production of, for example, printing plates, in particular lithographic printing plates; printed circuits; and integrated circuits. Radiation sensitive devices for use in the production of lithographic printing plates usually consist of a metallic support sheet, which is mechanically and/or chemically treated to provide a suitable working surface and which carries the radiation sensitive coating. In use, the device is image-wise exposed to actinic light using either a negative or a positive transparency of an appropriate subject. The effect of the actinic light is to alter the solubility of the radiation-sensitive coating. The image-wise exposed device is then processed. The processing step involves contacting the image-wise exposed device with a developer to selectively remove unwanted areas of coating from the support sheet to leave an image constituted by the areas of the coating remaining on the support sheet. Other types of printing plates and printed and integrated circuits are produced in a similar manner.

The negative or positive transparency commonly comprises a silver halide layer which forms and provides a line image of a half-tone image or a continuous tone image, or any combination of such images. Of the numerous radiation sensitive coatings that can be used for the devices, poly(vinyl cinnamate) and diazo resins are typical of those that can be used in conjunction with negative transparencies, whilst dichromated gum and quinone diazides optionally in combination with novolak resins are representative of those that can be used when exposure is carried out beneath a suitable positive transparency.

The precise processing routine, and the developer liquids used, depend on the solubility and chemical characteristics of the radiation sensitive coating being processed. Whilst the processing may be done manually it is increasingly being carried out in automatic processors.

It is with automatic processing that the present invention is concerned.

Some radiation sensitive coating/developer combinations are significantly affected by the developer temperature and variation from the predetermined temperature results in incorrect development and unsatisfactory reproduction of the transparency. As is well known, a measure of the ability of a radiation sensitive plate to reproduce a transparency may be obtained by exposing the plate through an exposure guide known as a "grey-scale" or "step-wedge". A typical example of such an exposure guide consists of a number of steps of increasing optical density, the first step being clear. The actual steps that are reproduced on the plate depend on the particular radiation sensitive coating/developer combination, the development conditions and the exposure conditions. However it is desirable that for a given set of conditions the reproduction of the step-wedge is always the same. Variation in the temperature of the developer could prevent such results being obtained.

It is an object of this invention to provide an apparatus for processing image-wise exposed radiation sensitive devices which compensates for any changes in the operating temperature of the developing liquid.

Because of the variations in the processing routines, there are problems in providing apparatus capable of processing different radiation sensitive devices. Thus, a processing apparatus with a developer bath length of, for example, 12" will have an optimum plate speed of 35" per minute when used for developing a negative working radiation sensitive plate with an organic solvent developer and an optimum plate speed of 20" per minute when used for developing a positive working radiation-sensitive plate with an alkaline developer.

It has been found that if an image-wise exposed positive working radiation sensitive device is processed by giving it a brief overall exposure to actinic radiation before or during the development, the development time can be decreased. When this exposure is given manually, it is difficult to obtain predictable and repeatable results because the exposure conditions are difficult to control. This problem can be solved by giving the device an overall exposure to relatively less intense actinic radiation for a relatively longer time whilst the plate moves along a path past the source of radiation. However, it has been found that the degree to which a given device needs to be subjected to an overall exposure in order to obtain a given result is dependent on the temperature of the developer.

It is another object of the invention to provide an apparatus for processing an image-wise exposed radiation sensitive device by giving the device an overall exposure, before or during development, which overal exposure is controlled in dependence on the temperature of the developer.

According to the present invention, there is provided an apparatus for processing an image-wise exposed radiation sensitive device which apparatus comprises (i) a container for developer liquid, (ii) a means of contacting the device with the developer liquid, (iii) a temperature sensitive member for sensing the temperature of the developer liquid and for producing an output signal in dependence on that temperature, and (iv) a means for controlling the processing of the device in a manner dependent on said output signal whereby the degree to which the device is processed is dependent on the temperature of the developer liquid.

In one embodiment the apparatus includes a means of moving the device with respect to the developer liquid, the output signal being used to control a motor for driving the device moving means. In one form of this embodiment, the device moving means comprises a pair or rollers for feeding the device at an appropriate speed along a path through the developer liquid. In an alternative form, the device moving means comprises a mechanism for dipping the device into the developer liquid in the container and for withdrawing the same after an appropriate time interval. In either case the residence time of the device in the apparatus is dependent upon the output signal i.e. upon the temperature of the developer liquid. Additionally, the output signal may also be used to control a motor for driving a roller arranged to agitate the developer liquid in contact with the device so that the speed of rotation of the roller is also dependent upon the output signal i.e. upon the developer liquid temperature.

In a further embodiment, the apparatus additionally includes a source of radiation arranged in or adjacent to the apparatus so as to subject the device to an overall exposure prior to or during its contact with developer liquid. In this case, the degree to which the device is subjected to radiation from said source may be controlled in dependence on said output signal. This may conveniently be effected by interposing a variable aperture between the source and the path and regulating the size of the aperture in dependence on said output signal.

Positive working radiation-sensitive devices typified by quinone diazide sensitised devices are used in the technique known as 'screenless lithography' i.e. the technique in which the device is exposed directly through a continuous tone master, without the use of the conventional half tone screen. The technique of subjecting the plate to an overall exposure before developing increases the range of tones that can be obtained. Again, however, it is difficult to obtain predictable and repeatable results when this is done manually. An apparatus of the invention including a source of radiation as aforesaid can be used to process these plates, variations in the tonal range being produced by varying the duration of the intensity of the overall exposure. Alternatively if it is desired to keep these parameters constant, the tonal range can be varied by altering the speed at which the plates pass the radiation source. Clearly, variation of exposure duration and intensity and variation of plate speed can be combined to give better control of the tonal range.

For a better understanding of the invention and to show how the same may be carried into effect, reference will now be made, by way of example, to the accompanying drawings, in which.

Figure 2:
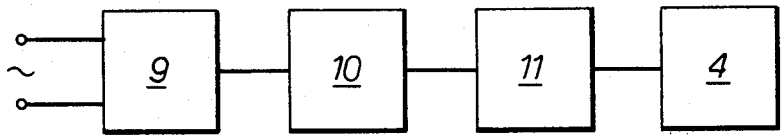
FIG. 2 is a block diagram of the control circuit of the apparatus of FIG. 1.
Figure 3:
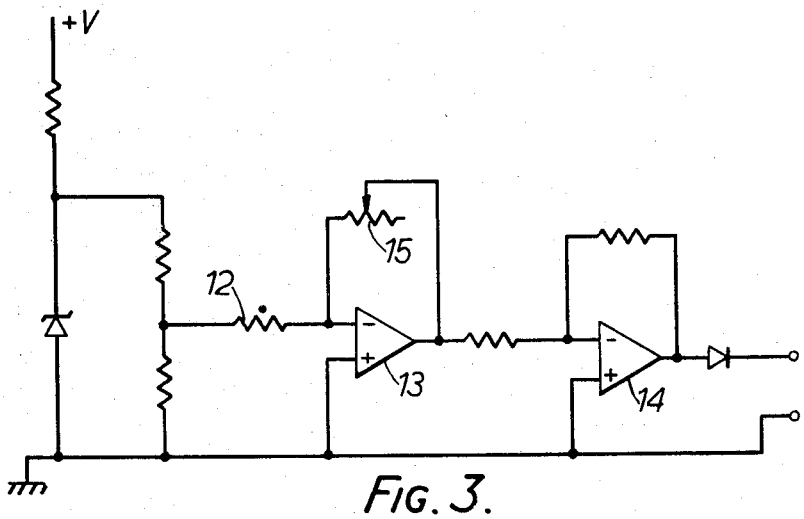
Figure 4:
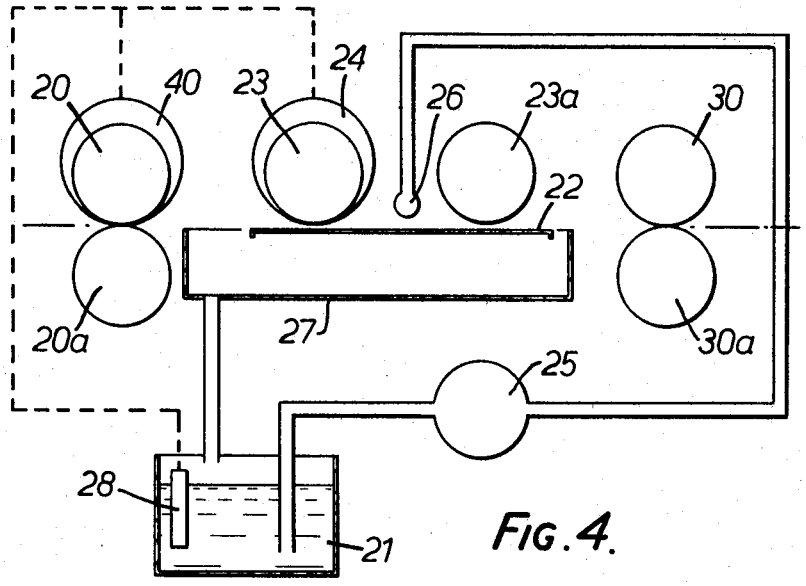
Figure 5:
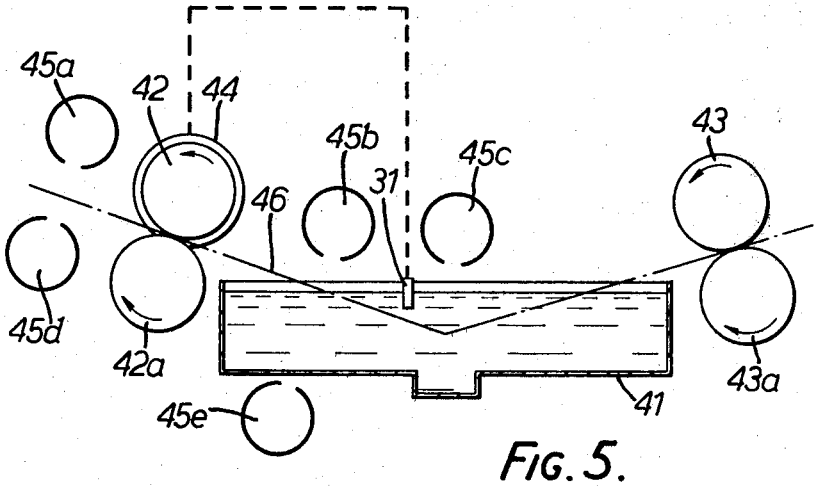
Figure 6:
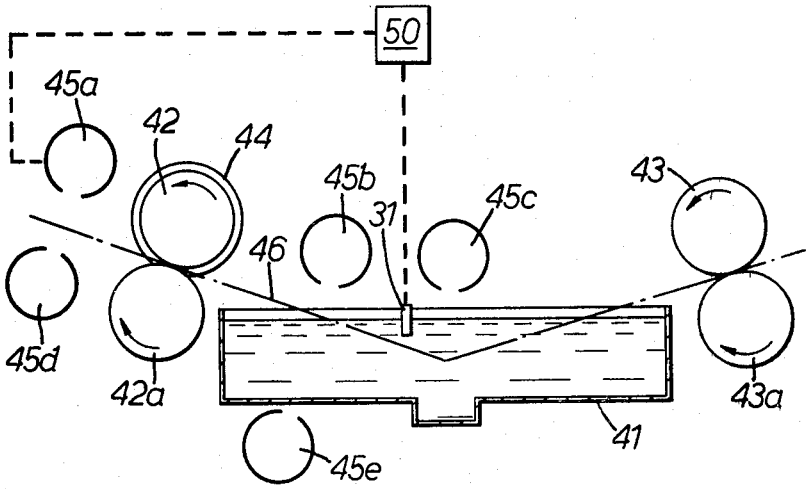
Figure 7A:
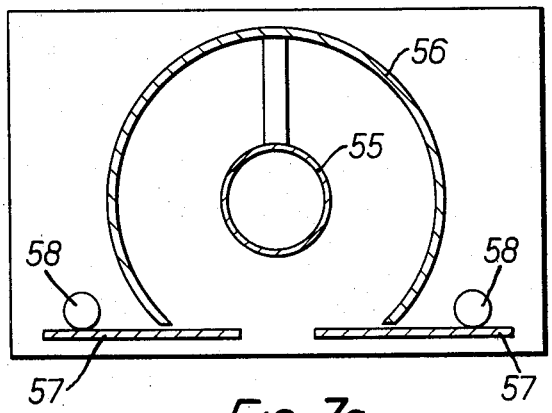
Figure 7B:
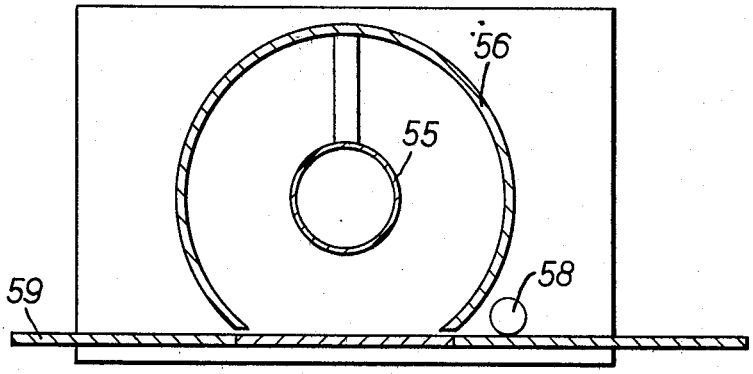
Figure 8:
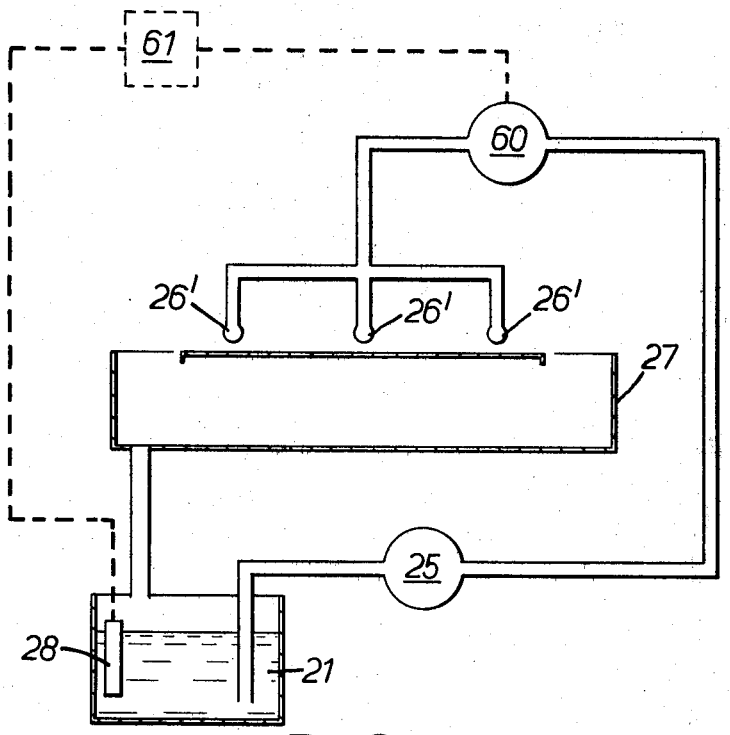

FIG. 3 is a circuit diagram of a part of the control circuit shown in FIG. 2, FIG. 4 is a schematic diagram of another apparatus in accordance with the present invention, FIG. 5 is a schematic diagram of a further apparatus in accordance with the present invention, FIG. 6 is a schematic diagram of yet another apparatus in accordance with the present invention, FIG. *7a* shows one embodiment of a part of the apparatus of FIG. 6, FIG. *7d* shows another embodiment of the part shown in FIG. *7a*, and FIG. 8 is a schematic diagram of a further apparatus in accordance with the present invention.

Figure 1:
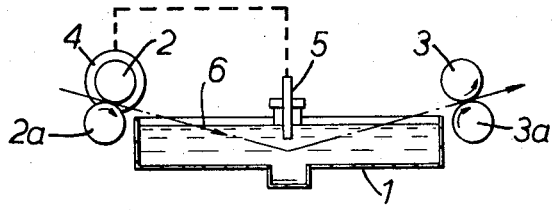
FIG. 1 is a schematic diagram of an apparatus is accordance with the present invention.

Referring to FIG. 1 the apparatus comprises a tank 1 for containing developer, a pair of rubber covered input rollers 2 and *2a*, a pair of rubber covered output rollers 3 and *3a* and a d.c. electric motor 4 connected to drive the roller 2. Roller *2a* is driven by contact with roller 2. (The rollers 3, *3a* may also be driven from the motor 4 if desired). A temperature sensitive member in the form of a probe 5 containing a thermistor is mounted in the tank 1 so as to lie in the developer.

Referring to FIG. 2, the electrical control circuit consists of a constant voltage source 9 in the form of an integrated circuit voltage regulator, a temperature voltage converter 10 incorporating the thermistor, and a servo-device 11 in the form of a d.c. thyristor controller, the output of which controls the speed of the motor 4.

As shown in FIG. 3, the regulated voltage from the source 9 is fed through the thermistor 12 to a pair of d.c. amplifiers 13 and 14. Variation in the temperature of the thermistor 12 causes a change in its resistance which in turn produces a change in the input voltage to the amplifier 13. The output of the amplifier 14 is connected to the servo device 11. A variable resistor 15 is provided to vary the gain of the amplifier 13.

In use, an image-wise exposed radiation sensitive device is fed into the input rollers 2 and *2a* which move the same along path 6 through the apparatus and then out of the apparatus via output rollers 3 and *3a*. During its passage along the path 6, the device is submerged in the developer in tank 1 whereby the more soluble areas of the image-wise exposed radiation sensitive coating of the device are selectively removed. The residence time of the device in the apparatus is automatically controlled in dependence on the temperature of the developer. The higher the temperature of the developer as sensed by the probe 5, the faster is the speed of the motor 4 and hence the shorter is the residence time.

Clearly, the temperature compensation that will be suitable for one combination of radiation sensitive coating and developer will not necessarily be suitable for another. Suitable variation of the change in motor speed with temperature may be obtained by adjusting the potentiometer 15. Further, in the case of a given radiation sensitive coating/developer combination the potentiometer 15 may be adjusted to vary the contrast of the developed device. Moreover, the setting of the potentiometer 15 may be varied to allow for an alteration in the activity of the developer as a result of partial exhaustion.

Referring to FIG. 4, the apparatus includes a pair of rubber covered input rollers 20 and *20a*, a pair of rubber covered output rollers 30 and *30a*, and a d.c. electric motor 40 for driving the rollers 20 and *20a*. The apparatus includes a separate reservoir 21 for developer liquid and a pump 25 for delivering developer liquid to a spray bar 26 located between a pair of plush covered rollers 23 and *23a* driven by a separate motor 24. A planar member 22 is located under the rollers 23 and *23a* and bar 26 and a catch tray 27 is provided to return processing liquid to the reservoir 21. The apparatus includes a temperature sensitive probe 28 similar to that of the apparatus of FIG. 1 and this is preferably located in the reservoir 21 as shown. The apparatus also includes an electrical control circuit of the type shown in FIGS. 2 and 3 and the output from the servo device of the circuit is fed to motor 40 and/or motor 24.

In use, an image-wise exposed radiation sensitive device is fed face upwards along a path between the input rollers 20 and *20a*, between the rollers 23 and *23a* and the member 22, and then between the output rollers 30 and *30a*. The exposed radiation sensitive coating of the device is contacted by the rollers 23 and *23a* and development is carried out by a combined scrubbing and solvent action. The arrangement is such that the higher is the temperature of the developer liquid, (i) the faster is motor 40 (and hence rollers 20 and *20a*) rotated and hence the shorter is the residence time of the device in the apparatus and (ii) the slower is motor 24 (and hence rollers 23 and *23a*) rotated and hence the liquid on the exposed coating is subjected to a less severe agitation. The degree to which the device is processed is thus dependent on the temperature of the developer liquid and, as in the case of the apparatus of FIGS. 1 to 3, this relationship can be adjusted as desired.

Referring to FIG. 5 the apparatus comprises a tank 41 for containing the developer and a pair of rubber covered input rollers 42 and 42*a* and a pair of rubber covered output rollers 43 and 43*a* defining a path 46 through the apparatus. An electric motor 44 is included to drive the roller 42, roller 42*a* being frictionally driven by roller 42. The rollers 43 and 43*a* may also be driven from the motor 44 if desired. The apparatus also includes a means of subjecting radiation sensitive plates passing along the path 46 to an overall exposure to actinic radiation. Preferably, this is in the form of a plurality of sources of actinic radiation and/or one or more moveable sources so that the apparatus can be used to process plates requiring to be subjected to an overall exposure from different positions. Examples of suitable positions are denoted by references 45*a* to 45*e*. The positions 45*d* and 45*e* are usable when the plate is being processed face down. In the case of position 45*e* the tank must, of course, be translucent. A means (not shown) is provided to sense the presence of a plate along said path 46 and to actuate the source of actinic radiation when the plate reaches a position along the path 46 at which it can receive radiation from the source. (Alternatively, the source may be actuated manually when the plate reaches a suitable position along the path). A temperature sensitive member in the form of a probe 31 containing a thermistor is mounted in the tank 41 so as to lie in the developer. The thermistor forms part of a control circuit of the type described with reference to FIGS. 2 and 3 and is operably connected to the motor 44 so that the speed of the motor increases (and hence the residence time of the plates decreases) with increase in developer temperature. Alternatively, or additionally, the thermistor may be operably connected to a means of regulating a variable aperture (e.g. in the form of a slit of adjustable width forming, for example, a part of a shutter mechanism) located between the radiation source and the plate path.

In use, an image-wise exposed radiation sensitive plate is fed into the input rollers 42 and 42*a* which move the same along the path 46 through the apparatus and then out of the apparatus via output rollers 43 and 43*a*. During its passage along the path 46, the device is submerged in the developer in the tank 41 whereby the more soluble areas of the image wise exposed radiation sensitive coating of the device are selectively removed. The residence time of the device is controlled in dependence on the developer temperature. As the device passes the source of actinic radiation the whole surface of the plate is exposed. In the case where the apparatus includes a variable aperture as above described, this too is regulated in dependence on the temperature of the developer liquid in order to give the device a desired overall exposure dependent on said temperature.

The source of actinic radiation may be of any suitable type, for example a mercury halide lamp, a pulsed xenon lamp or an ultra violet lamp. Further, in the case where the apparatus is such as to give the plate an overall exposure dependent on the developer temperature, it may include one or more filters and a means of interposing the same between the plate path and the source as appropriate in dependence on said temperature so that the amount of radiation reaching the plate during the overall exposure is dependent on the temperature of the developer.

Referring now to FIG. 6 parts corresponding to parts of the apparatus of FIG. 5 are denoted by like reference numerals. The apparatus is identical to that of FIG. 5 except that the probe 31 is not operably connected to motor 44. In this case the probe 31 is operably connected to a means 50 of regulating the amount of radiation reaching the plate from the radiation source (45*a*) so that the degree to which the plate is given a uniform overall exposure as it passes through the apparatus is controlled in dependence on the developer temperature.

Means 50 is shown schematically in FIG. 6. It may, for example, be in the form of a controllable aperture located between the source and the plate path. Such an arrangement is illustrated in FIG. *7a*. Referring to this Figure, the source includes a tubular lamp 55 located within a casing 56 having a slit arranged transversely with respect to the path such that radiation from the source can impinge on plates passing along the plate path. Shutters 57 are mounted at the sides of the slit and co-operate with the slit to provide a variable aperture for the source. The shutters are displaceable towards one another so as to reduce the size of the aperture (and hence reduce the amount of radiation reaching the path) or away from one another so as to increase the size of the aperture (and hence increase the amount of radiation reaching the path). Each shutter 57 carries a rack which is engaged by a pinion 58 driven by a motor (not shown) so as to displace the shutters 57. The motor is operably connected to the probe immersed in the developer liquid in a manner such that the degree to which the pinion is rotated (and hence the size of the aperture) is dependent on the output signal generated by the probe and its associated circuitry. In this way, the amount of radiation to which the plates are subjected is determined by the developer temperature.

In an alternative embodiment the means 50 may be in the form of a plurality of filters arranged to be selectively interposed between the source and the plate path. Such an arrangement is illustrated in FIG. *7b* where parts corresponding to parts of FIG. *7a* are denoted by like reference numerals. The slit is closed by means of a displaceable radiation filter 59 which comprises adjacent portions of differing radiation transmittance. The filter 59 carries a rack which is engaged by the pinion 58. Rotation of the pinion causes the filter 59 to be displaced across the slit so that one or other of its portions is interposed between the source and the path. The amount of radiation reaching the path is dependent on which of these portions is interposed between the source and the path. As in the case of FIG. *7a* the degree to which the pinion is rotated (and hence which portion is so interposed in any given case) is dependent on the output signal generated by the probe and its associated circuitry and thus the amount of radiation to which the plates are subjected is determined by the developer temperature.

Referring now to FIG. 8, parts corresponding to parts of FIG. 4 are denoted by like reference numerals. In this embodiment, the image-wise exposed radiation sensitive device is placed on the member 22 face upwards. (The device may be placed in position manually or automatically). Developer liquid is sprayed onto the device from a plurality of spray bars 26' arranged so that the entire surface of the stationary device is contacted with developer liquid. The liquid line carrying developer liquid from the reservoir 21 to the spray bars 26' includes a valve 60 actuated by a timer 61 operably connected to the output signal generated by the probe 28 and its associated circuitry. The arrangement is such that the period of time during which developer liquid issues from the spray bars 26' is dependent on the developer liquid temperature.

The following Examples illustrate the invention.

EXAMPLE 1

A positive working presensitised plate consisting of a grained and anodised aluminium substrate coated with a radiation sensitive mixture of a naphthoquinone diazide sulphonic acid ester and a novolak resin, was exposed beneath a half-tone positive accompanied by a continuoustone step-wedge to light emitted from a mercury halide source for 2 minutes. It was then processed using the apparatus of FIGS. 1 to 3 with the tank filled with a developer comprising a 6% aqueous solution of sodium metasilicate at a temperature of 20° C. At this temperature, the motor drove the input rollers at a speed which was such that the plate was immersed in the developer for two minutes. The image of the processed plate contained eight "grey" steps of the control step-wedge.

The example was repeated with the developer at 25° C. At this temperature, the motor drove the input rollers at an increased speed under the control of the temperature sensitive member such that the plate was immersed for one minute. The processed image included the same eight 'grey' steps and no difference could be detected between the reproduction of the positives when compared with that previously obtained at 20° C.

For comparison, the example was repeated with the temperature of the developer at 25° C. but without temperature compensation. The plate was thus immersed for two minutes. A severely over-developed image containing more "grey" steps and no "solid" steps was obtained. The reproduction of the positives was bad and unacceptable.

EXAMPLE 2

A deep-etch plate consisting of an anodised substrate having a radiation sensitive coating based on dichromated gum arabic was exposed through a line and half-tone positive master and a continuous tone step-wedge.

The exposed plate was fed into the apparatus of FIG. 1 to 3 with the tank containing a 50% w/v aqueous solution of calcium chloride at 15° C. The apparatus was adjusted so that the plate was developed for 6 minutes.

The plate was finally washed with anhydrous alcohol to remove all traces of the developer. Examination showed that a satisfactory resist had been obtained and that the step-wedge had been developed until step number 10 had been cleared.

The example was repeated with the developer at 25° C. At this temperature the speed of the motor increased under the influence of the temperature sensitive member such that the plate was developed for 2 minutes and 20 seconds. A similar satisfactory resist was obtained.

For comparison, a further similar plate was processed with the developer at 25° C. but without the temperature compensation. The plate was therefore developed for 6 minutes and resulted in a badly overdeveloped resist. The image of the step-wedge had been cleared to step 6. After further conventional processing it was observed that the final printing plate was much too dark due to unduly large half-tone dots and to scum.

EXAMPLE 3

Three smooth surfaced sheets of photo-engraving zinc were coated with the positive working radiation sensitive composition of Example 1 and then exposed and developed as in that Example. The exposed plates were then etched in a powderless etching bath for several minutes to produce letter press plates. As before the plates processed using the temperature compensation device were indentical and suitable for printing, whilst the other plate was unsuitable due to the absence of solid areas on examination of the reproduction of the step-wedge.

EXAMPLE 4

Two negative working presensitised printing plates consisting of a grained and anodised substrate having a radiation sensitive coating comprising the dinamylidenemalonic acid half ester of poly(2,3-epoxypropyl methacrylate) was exposed beneath a line and half-tone negative and a continuous tone step-wedge for 1 minute to light from a mercury halide source. The plates were developed by passing them through the apparatus of FIGS. 1 to 3 containing 6% aqueous sodium silicate solution as developer. In one case the temperature of the developer was 20° C. and the development time was 30 seconds. In the other case, the developer temperature was 25° C. and this resulted in a development time of 20 seconds under the influence of the temperature sensitive member. In both cases the same reproduction of the step-wedge was obtained.

EXAMPLE 5

Example 1 was repeated except that the plates were exposed beneath a continuous tone positive in place of the half-tone positive and that the apparatus contained a developer comprising 60 g. of sodium metasilicate and 180 ml of polyethylene glycol (M.Wt 300) per liter of distilled water. Both of the plates processed under the temperature compensated conditions possessed 10 "grey" steps and 10 solid steps on the step-wedge and satisfactory reproduction of the positive. The plate processed without temperature compensation was over developed and the reproduced step-wedge possessed 16 "grey" steps but no solid steps.

The results in this Example were obtained with the potentiometer 15 set to give a change in output of 0.95 V per 1° C. change in temperature.

EXAMPLE 6

An apparatus similar to that shown in FIG. 1 but of a size suitable for film processing was used to develop a "Plus X" panchromatic film (supplied by Kodak Ltd.) The tank contained "Microdol X" developer (Kodak Ltd.) at a temperature of 20° C. At this temperature the speed of the rollers was such that the film was developed for 10 minutes. A further similar film was processed with the developer at a temperature of 24° C. and in this case the development time was 7 minutes.

EXAMPLE 7

A temperature compensated apparatus for processing silver halide diffusion transfer materials was constructed by incorporating in the apparatus described in British Patent Specification No. 1,425,217, a temperature sensitive probe and electrical control circuit as described with reference to FIGS. 1 to 3. A sheet of exposed silver halide diffusion transfer negative paper and a positive receiving sheet in the form of an ADT aluminium lithographic plate (supplied by the Howson-Algraphy Group of Vickers Ltd.) were fed together through the apparatus which was filled with an A D T monobath developer/fixer at 18° C. The apparatus was adjusted to give an immersion time of 6 seconds. The experiment was repeated with the monobath at 30° C. and in this case the immersion time was 3 seconds.

EXAMPLE 8

Three positive working presensitised radiation sensitive plates comprising a grained and anodised substrate having a radiation sensitive coating based on a quinone diazide and a novolak resin were identically image-wise exposed beneath a half tone positive. The first plate was processed face upwards using an apparatus as described in FIG. 5 with the tank 41 filled with a developer comprising a 6% aqueous solution of sodium metasilicate at ambient temperature (20° C.). The apparatus had a path length of 12" and was driven at a speed of 30" per minute. No overall exposure was given and a badly under developed plate resulted.

The second plate was processed in the same way except that it was subjected to an overall exposure as it moved through the apparatus from an actinic radiation source comprising a 3ft 30 watt fluorescent tube 2 cm from the plate path in position 5*a*. Thus the overall exposure was given prior to the plate being contacted with the developer at 20° C. The resultant plate was correctly developed.

The third plate was processed in the apparatus with the tank 41 filled with a developer comprising a 6% aqueous solution of sodium metasilicate at 25° C. whilst given a similar overall exposure to that given to the second plate. The speed of motor 44 was controlled by the probe 31 such that the plate speed was 45 inches per minute. Results were obtained similar to those obtained in respect of the second plate.

EXAMPLE 9

Three radiation sensitive plates identical to those of Example 8 were exposed beneath a continuous tone step-wedge to light emitted from a mercury halide lamp for 21 minutes. The plates were then processed in an apparatus as described in FIG. 5 wherein both the residence time and the width of the radiation source aperture were dependent on the developer temperature. The tank was filled with a 6% aqueous solution of sodium metasilicate.

Plate 1 was processed without an overall exposure at a speed of 20" per min with the developer at 18° C. The final image possessed 6 grey tones (step 2 clear, step 9 solid).

Plate 2 was processed at the same speed and at the same developer temperature but was also subjected to an overall exposure as it passed through the apparatus by means of a Philips 300 watt ultra violet lamp spaced 5 cm from the plate path in position 45*a*. The control circuit was adjusted such that the aperture of the radiation source was 4 cm wide at the developer temperature (18° C.). The final image possessed 12 grey tones (step 4 clear, step 17 solid).

Plate 3 was processed using the same apparatus as used for plate 2 but with the developer at a temperature of 35° C. Because of the increased temperature, the speed of motor 44 increased (and hence the residence time decreased) and the aperture widened to 8 cm. The final image obtained was similar to that of plate 2.

The apparatus of the present invention provides several advantages over conventional processors. It is possible to obtain repeatable plate processing accurately without having to monitor and adjust the working temperature of the developer, which thus can always be at the ambient temperature. Time is saved when the developer temperature is low e.g. at the start of processing in a cold environment, as it is not necessary to wait until the developer is heated to the normal working temperature as is the case with conventional developers. Further, in the case where the ambient temperature is higher than the normal working temperature, there is no need to provide a means of cooling the developer. This is particularly important in the case of large processors containing 30 or 40 liters of developer.

I claim:

1. An apparatus for processing image-wise exposed radiation sensitive material which apparatus comprises:

(i) a container for developer liquid;

(ii) a means for contacting the material with the developer liquid;

(iii) a temperature sensitive member for sensing the temperature of the developer liquid and for producing an output signal in dependence on that temperature; and (iv) a source of actinic radiation arranged in or adjacent to the apparatus so that the processing effected by the apparatus includes subjecting the material to an overall exposure prior to or during its contact with the developer liquid, the output signal being arranged to control the extent to which the material is subjected to said overall exposure.

2. A method of processing image-wise exposed radiation sensitive material which comprises:

contacting the material with a developer liquid so as to process the material;

agitating the developer liquid in contact with the material;

sensing the temperature of the developer liquid;

controlling the contact time of the material and the developer liquid in a manner dependent on the temperature of the developer liquid; and controlling the extent to which the developer liquid is agitated in contact with the material in a manner dependent on the temperature of the developer liquid.

3. A method of processing image-wise exposed radiation sensitive material which comprises:

contacting the material with a developer liquid so as to process the material;

subjecting the material to an overall exposure to actinic radiation prior to or during its contact with the developer liquid;

sensing the temperature of the developer liquid; and controlling the extent to which the material is subjected to said overall exposure in a manner dependent on the temperature of the developer liquid.

4. An apparatus for processing image-wise exposed radiation sensitive material which apparatus comprises:

(i) a container for developer liquid;

(ii) a means for contacting the material with the developer liquid;

(iii) a temperature sensitive member for sensing the temperature of the developer liquid and for producing an output signal in dependence on that temperature;

(iv) a roller in contact with the material for agitating the developer liquid in contact with the material; and (v) a motor for driving the agitating roller, said temperature sensitive member being operably connected to the motor for driving the agitator roller so that said output signal controls the speed of the motor whereby the extent to which the developer liquid is agitated in contact with the material is dependent on the temperature of the developer liquid.

5. An apparatus as claimed in claim 4 wherein the means for contacting the material with the developer liquid comprises a means for moving the material along a path through the developer liquid.

6. An apparatus as claimed in claim 5 and additionally including a motor for driving the material moving means, said temperature sensitive member being operably connected to said motor for driving the material moving means so that said output signal also controls the speed of said motor for driving the material moving means whereby the residence time of the material in the apparatus is also dependent on the temperature of the developer liquid.

7. An apparatus as claimed in claim 4 which additionally comprises a source of actinic radiation arranged in or adjacent to the apparatus so that the processing effected by the apparatus includes subjecting the material to an overall exposure prior to or during its contact with the developer liquid, said temperature sensitive member being operably connected to said source so that the output signal also controls the source whereby the extent to which the material is subjected to said overall exposure is also dependent on the temperature of the developer liquid.

8. An apparatus as claimed in claim 7 which additionally includes a variable aperture between the source and the path, and a means of opening and closing the aperture, said temperature sensitive member being operably connected to said means of opening and closing the aperture so that said output signal controls the size of the aperture whereby the extent to which the material is subjected to said overall exposure is dependent on the temperature of the developer liquid.

9. An apparatus as claimed in claim 4 wherein the means for contacting the material with the developer liquid comprises a means of feeding developer liquid to the material and the apparatus additionally includes a means for regulating said feeding means, said temperature sensitive member being operably connected to said means for regulating said feeding means so that said output signal also controls the feeding means whereby the developer liquid is fed to the material for a period of time dependent on the temperature of the developer liquid.

* * * * *

UNITED STATES PATENT AND TRADEMARK OFFICE

CERTIFICATE OF CORRECTION

PATENT NO. : 4,240,737

DATED : December 23, 1980

INVENTOR(S) : Leslie Edward Lawson

It is certified that error appears in the above-identified patent and that said Letters Patent are hereby corrected as shown below:

On the title page Insert Foreign Application Data

-- August 18, 1977 Great Britain . . . 34796/77 (provisional)

March 2, 1978 Great Britain . . . 8402/78

May 26, 1978 Great Britain . . . 34796/77 (final) --

Signed and Sealed this

*Second* Day of *August 1983*

[SEAL]

*Attest:*

GERALD J. MOSSINGHOFF

*Attesting Officer*

*Commissioner of Patents and Trademarks*